US010597914B2

(12) United States Patent
Ishiguro et al.

(10) Patent No.: US 10,597,914 B2
(45) Date of Patent: Mar. 24, 2020

(54) VEHICLE DOOR LATCH DEVICE

(71) Applicants: MITSUI KINZOKU ACT CORPORATION, Yokohama-shi, Kanagawa (JP); GECOM CORPORATION, Greensburg, IN (US)

(72) Inventors: Katsuyuki Ishiguro, Novi, MI (US); Daisuke Enomoto, Yokohama (JP)

(73) Assignees: MITSUI KINZOKU ACT CORPORATION, Kanagawa (JP); GECOM CORPORATION, Greensburg, IN (US)

( * ) Notice: Subject to any disclaimer, the term of this patent is extended or adjusted under 35 U.S.C. 154(b) by 416 days.

(21) Appl. No.: 15/531,029

(22) PCT Filed: Nov. 27, 2014

(86) PCT No.: PCT/JP2014/081373

§ 371 (c)(1),
(2) Date: May 26, 2017

(87) PCT Pub. No.: WO2016/084191

PCT Pub. Date: Jun. 2, 2016

(65) Prior Publication Data

US 2018/0010370 A1 Jan. 11, 2018

(51) Int. Cl.
*E05B 85/26* (2014.01)
*E05B 77/32* (2014.01)
(Continued)

(52) U.S. Cl.
CPC ..... *E05B 85/26* (2013.01); *E05B 77/32* (2013.01); *E05B 79/08* (2013.01); *E05B 79/10* (2013.01);
(Continued)

(58) Field of Classification Search
CPC ..... Y10T 292/1082; Y10T 292/1047; Y10T 292/108; Y10T 292/1076; Y10T 70/5889;
(Continued)

(56) References Cited

U.S. PATENT DOCUMENTS 6,945,574 B2 * 9/2005 Hayakawa ..... E05B 81/06 292/201
7,021,681 B2 4/2006 Hayakawa et al.
(Continued)

FOREIGN PATENT DOCUMENTS

JP 2008-088708 A 4/2008
JP 4196617 B2 12/2008
(Continued)

OTHER PUBLICATIONS

International Search Report Corresponding to PCT/JP2014/081373 dated Mar. 31, 2015.
(Continued)

*Primary Examiner* — Mark A Williams
(74) *Attorney, Agent, or Firm* — Davis & Bujold PLLC; Michael J. Bujold

(57) ABSTRACT

A vehicle door latch device comprises an outside lever, a locking lever, a holding member, an opening link and a spring. The spring applies an urging force, smaller than an elastic holding force of the holding member in an unlocking direction, to the opening link. A coil is held in a holding recess of a rotation central portion of the opening link. The first arm engages with the outside lever, and the second arm engages with the opening link. If a panic state occurs, the locking lever can rotate to an unlock position, and the opening link returns to an initial position before a releasing action and is moved to the unlock position by the urging force of the spring.

3 Claims, 15 Drawing Sheets

(51) Int. Cl.

| | |
|---|---|
| ***E05B 79/08*** | (2014.01) |
| ***E05B 81/16*** | (2014.01) |
| ***E05B 81/34*** | (2014.01) |
| ***E05B 81/36*** | (2014.01) |
| ***E05B 81/06*** | (2014.01) |
| ***E05B 79/10*** | (2014.01) |
| ***E05B 81/00*** | (2014.01) |
| ***E05B 83/36*** | (2014.01) |
| *E05B 85/02* | (2014.01) |
| *E05B 85/24* | (2014.01) |

(52) U.S. Cl.
CPC ..... *E05B 81/00* (2013.01); *E05B 81/06* (2013.01); *E05B 81/16* (2013.01); *E05B 81/34* (2013.01); *E05B 81/36* (2013.01); *E05B 83/36* (2013.01); *E05B 85/02* (2013.01); *E05B 85/243* (2013.01)

(58) Field of Classification Search
CPC ..... Y10T 74/20582; Y10T 292/09; Y10T 292/102; Y10T 292/1055; E05B 81/06; E05B 81/16; Y10S 292/23
See application file for complete search history.

(56) References Cited

U.S. PATENT DOCUMENTS

| | | | | |
|---|---|---|---|---|
| 7,568,741 | B2 | 8/2009 | Odahara | |
| 8,151,610 | B2 * | 4/2012 | Fujihara | E05B 77/283 292/201 |
| 8,403,379 | B2 | 3/2013 | Ishiguro et al. | |
| 9,376,843 | B2 | 6/2016 | Akizuki et al. | |
| 2001/0033082 | A1 * | 10/2001 | Hayakawa | E05B 81/06 292/216 |
| 2004/0119296 | A1 * | 6/2004 | Hayakawa | E05B 81/06 292/216 |
| 2008/0136195 | A1 * | 6/2008 | Ooe | E05B 85/01 292/198 |
| 2009/0241617 | A1 * | 10/2009 | Takahashi | E05B 81/16 70/257 |
| 2011/0198870 | A1 * | 8/2011 | Nagaoka | E05B 77/265 292/200 |
| 2012/0256429 | A1 * | 10/2012 | Nagaoka | E05B 77/34 292/200 |
| 2014/0028036 | A1 * | 1/2014 | Akizuki | E05B 15/04 292/336.3 |

FOREIGN PATENT DOCUMENTS

| | | | |
|---|---|---|---|
| JP | 2009-235754 | A | 10/2009 |
| JP | 2012-211502 | A | 11/2012 |
| JP | 2012-225112 | A | 11/2012 |

OTHER PUBLICATIONS

Written Opinion Corresponding to PCT/JP2014/081373 dated Mar. 31, 2015.

* cited by examiner

VEHICLE DOOR LATCH DEVICE

BACKGROUND OF THE INVENTION

The present invention relates to a vehicle door latch device.

In a vehicle door latch device, when a locking mechanism is in a lock state, an unlocking operation is made with or right after an opening action of a door, and there are means for avoiding a panic state where it cannot be turned to an unlock state as described in JP4196617B2.

In the vehicle door latch device in JP4196617B2, a locking lever that constitutes a locking mechanism is divided to a main lever and a subsidiary lever that is pivotally mounted on the same axis as of the main lever and can move relative to the main lever. In the lock state, right after or with the door-opening action, an unlocking operation is carried out, it causes the panic state where an opening link (opening member in JP4196617B2) coupled to a subsidiary lever contacts an opening lever (lift lever) from a direction where an operation is impossible, the main lever can be moved to an unlock position against an urging force of a spring acting on between the main lever and the subsidiary lever, and the door-opening action stops once, thereby moving the subsidiary lever and the opening link to the unlock position.

However, in the vehicle door latch device in JP4196617B2, in addition to the two divided structure of the main lever and the subsidiary lever, a spring for an urging force is provided between the two divided levers, thereby increasing the number of parts and production cost.

SUMMARY OF THE INVENTION

In view of the disadvantages, it is an object of the invention to provide a vehicle door latch device in which a panic state can securely be avoided.

DETAILED DESCRIPTION OF PREFERRED EMBODIMENT

Figure 1:
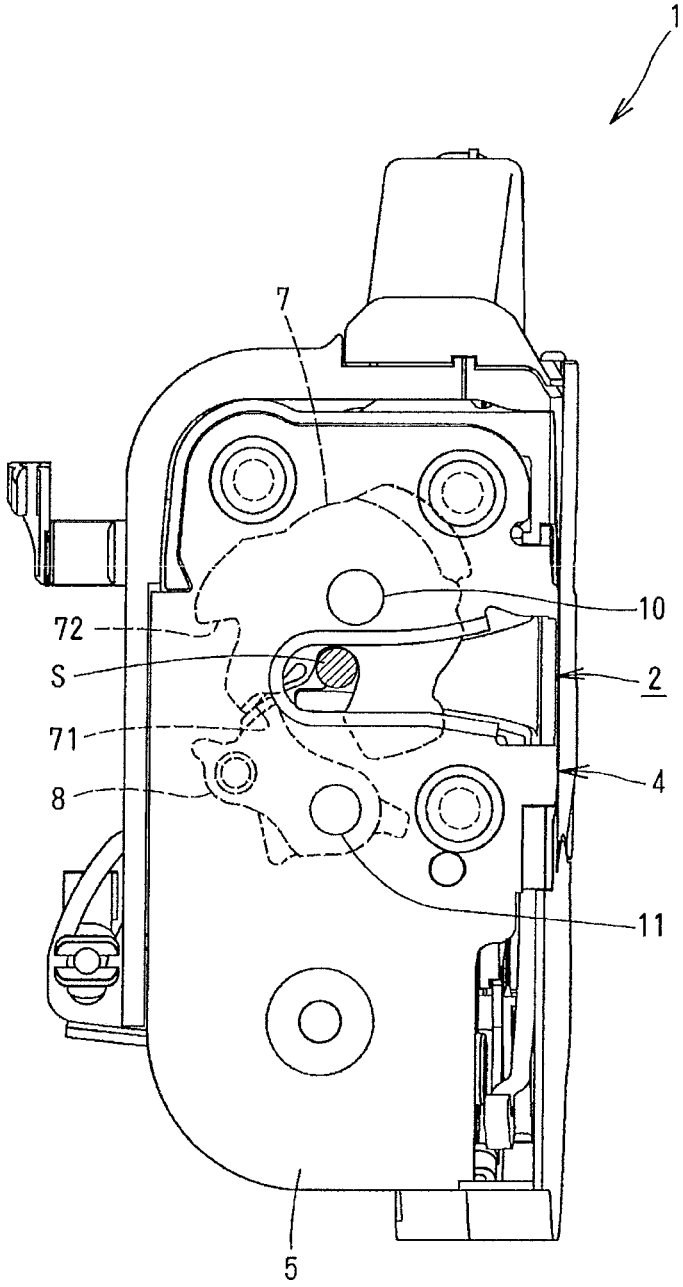
FIG. 1 is a front elevational view of a vehicle door latch device according to the present invention.
Figure 2:
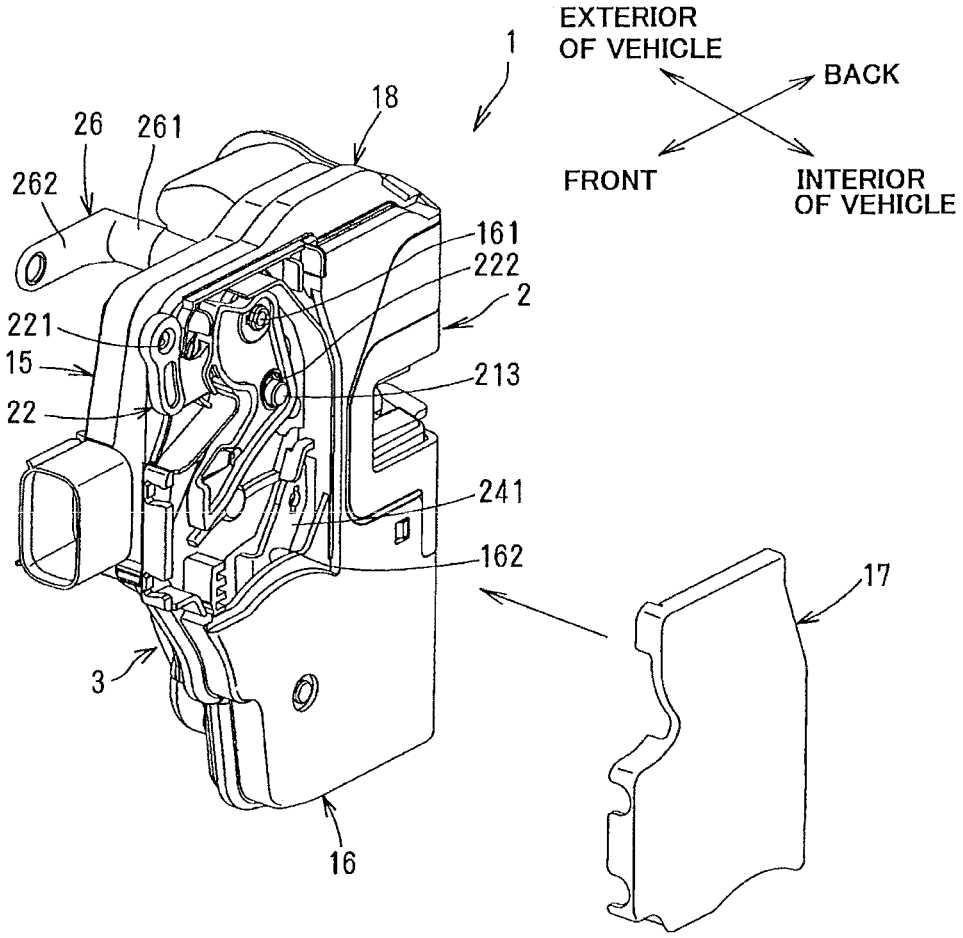
FIG. 2 is a perspective view of the door latch device seen from a front obliquely.

One embodiment of the present invention will be described with respect to the drawings.

(The Basic Structure of a Door Latch Device 1)

In FIGS. 1 to 4, a door latch device 1 is mounted in a front door of a vehicle and comprises an engagement unit 2 for holding the door closed and an operation unit 3 connected to the engagement unit 2.

The engagement unit 2 comprises, as main elements, a base (not numbered) comprising a synthetic-resin body 4 fixed to the rear end in the door with a plurality of bolts (not shown), a metal cover member 5 that closes a rear surface of the body 4 and a metal back member 6 fixed to a front surface of the body 4; an engagement mechanism (not numbered) including a latch 7 that can engage with a striker S fixed to a vehicle body and a ratchet 8 that can engages with the latch 7; and an opening lever 9 that releases the ratchet 8 from the latch 7.

The latch 7 is pivotally mounted via a latch shaft 10 that lies longitudinally of the vehicle between the body 4 and the cover member 5, and comprises a full-latch engagement portion 71 and a half-latch engagement portion 72 that can engage with the ratchet 8 at a lower part of the outer circumference.

While the door is closing, the latch 7 rotates clockwise against a spring (not shown) from an open position (which it rotates counterclockwise by about 90 degrees from the position in FIG. 1) that does not engage with the striker S and corresponds to the open door to a full-latch position (in FIG. 1) in which the latch 7 fully engages with the striker S in the fully closed door via a half-latch position in which the latch 7 slightly engages with the striker S and vice versa while the door is opening.

Under the latch 7, the ratchet 8 is pivotally mounted between the body 4 and the cover member 5 via a ratchet shaft 11 that lies longitudinally of the vehicle, and is urged by a spring 12 in an engagement direction (clockwise in FIG. 1 in a direction where the ratchet 8 engages with the full-latch engagement portion 71 and the half-latch engagement portion 72 of the latch 7). The ratchet 8 engages with the full-latch engagement portion 71 of the latch 7 to hold the door fully closed and with the half-latch engagement portion 72 to hold the door slightly open.

Figure 3:
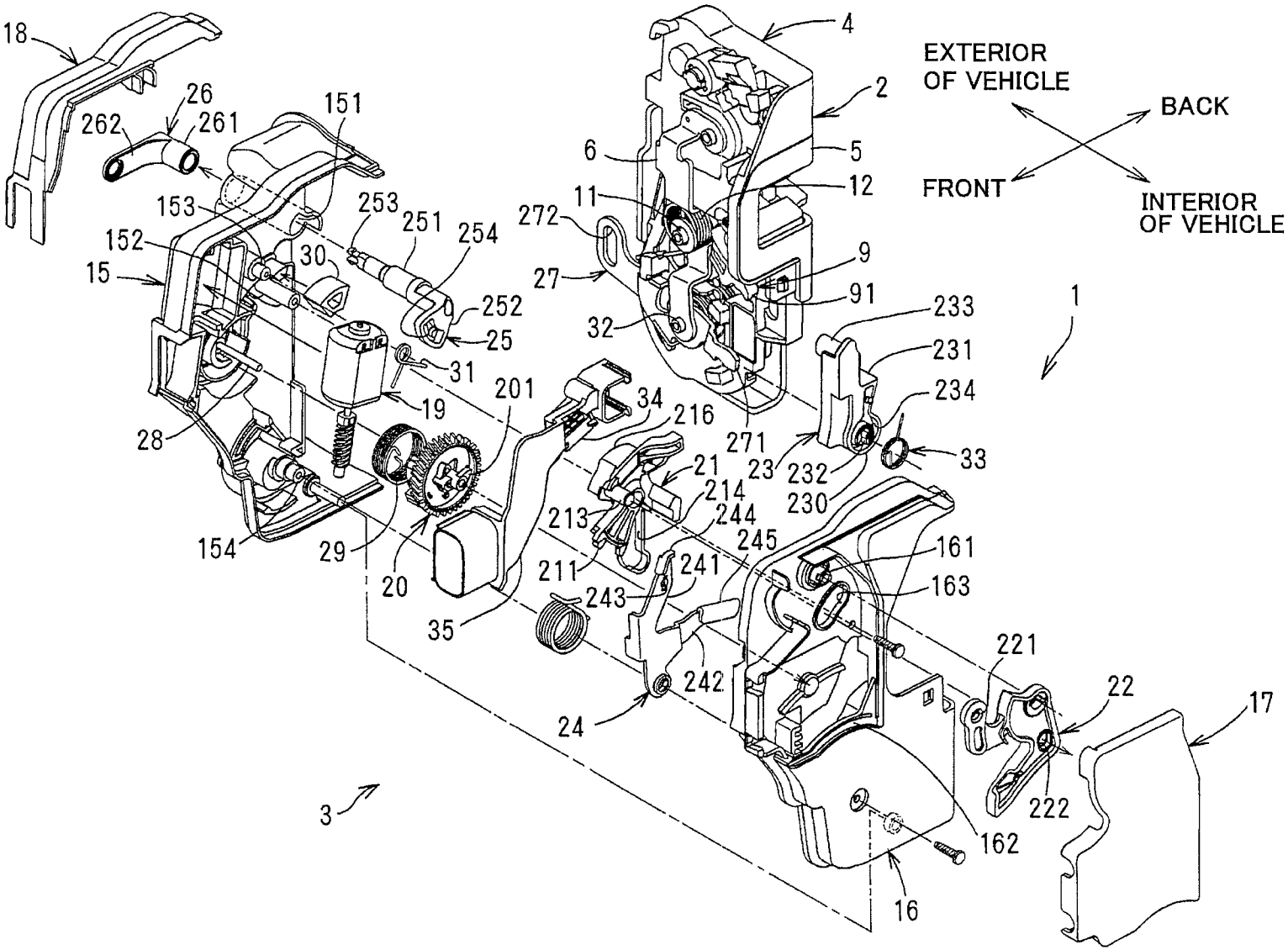
FIG. 3 is an exploded perspective view of the door latch device seen from the front obliquely.

In FIG. 3, an opening lever 9 is pivotally mounted coaxially with the ratchet 8 on a front surface of the body 4 to rotate with the ratchet 8 and comprises a released portion 91 on an end extending toward an interior of the vehicle.

The operation unit 3 comprises a cover (not numbered) comprising a first synthetic-resin cover 15 fixed to the body 4; a second synthetic-resin cover 16 that closes a side facing the interior of the vehicle, a synthetic-resin waterproof side cover 17 that closes an upper half of the second cover 16 from the interior of the vehicle, a waterproof top cover 18 that covers upper surfaces of the first cover 15 and the second cover 18 and an operation mechanism (not numbered) held in the cover.

In FIG. 3, the operation mechanism comprises a motor 19; a worm wheel 20 reversibly rotating with the motor 19; a locking lever 21 that can move between an unlock position for making the door open and a lock position for making the door not to open; a knob lever 22 connected to a manual knob (not shown); an opening link 23 that moves with the locking lever 21 between the unlock position and the lock position; an inside lever 24 connected to an inside handle (not shown) for opening the door on the door inside the vehicle; first and second key levers 25, 26 that move with a key cylinder (not shown) on the door outside the vehicle; an outside lever 27 connected to an outside handle (not shown) for opening the door on the door outside the vehicle; and a detecting switch 34 for detecting a position of the locking lever 21.

The locking lever 21, the knob lever 22 and the opening link 23 constitute a locking mechanism of the door latch device 1. The outside handle and the inside handle correspond to an operating handle, and the motor 19 and the locking knob correspond to locking means of the present invention.

The worm wheel 20 is pivotally mounted via a shaft 28 between the first cover 15 and the second cover 16 and normally or reversely rotates from a neutral position (for example in FIG. 4) with the motor 19 against the spring 29 around the shaft 28. The motor 19 stops, and the worm wheel 20 is returned to the neutral position in FIG. 4 from a position to which the worm wheel 20 is rotated by the spring 29.

The knob lever 22 is pivotally mounted to a side of the second cover 16 via an axial portion 161 of the second cover 16, and a connecting portion 221 at the front is connected to the locking knob via a connecting member such as a Bowden cable or a rod (not shown). Based on an unlocking action and a locking action of the locking knob, the knob lever 22 can rotate between the unlock position in FIGS. 4 and 9 and the lock position in FIG. 11 to which it rotates at a certain angle from the unlock position.

The waterproof side cover 17 is fixed to the side of the second cover 16 after the knob lever 22 is connected to the second cover 6, and partially closes the side of the second cover 16 including an area where the knob lever 22 is installed, thereby preventing rain water from coming into the area where the knob lever 22 is installed.

The axial portion 151 of the first key lever 25 is pivotally mounted in a bearing hole 151 extending transversely of the vehicle at an upper part of the first cover 15, and a lever portion 252 is disposed at one end (disposed within the first cover 15). The other end 253 (projecting from the first cover 15) is connected to the second key lever 26. An arc-shaped hole 254 around the axial portion 251 as a center is formed in the lever portion 252 so that the locking lever 21 is connected as described later.

The second key lever 26 comprises a cylindrical portion 261 and a lever portion 262 and is coupled to the first key lever 26 by inserting the other end 253 of the first key lever 25 into the cylindrical portion 261. The end of the lever portion 262 is connected to the key cylinder via a motion transmitting member such as a vertical rod and a link (not shown). Hence, the first and second levers 25, 26 rotate in an unlocking direction (clockwise in FIG. 10) or in a locking direction (counterclockwise in FIG. 10) from the neutral portion (in FIG. 10) based on operation of the key cylinder, and returns to the neutral position after the rotation is transmitted to the locking lever 21.

The locking lever 21 is pivotally mounted via an axial portion 152 of the first lever 15 that projects from the first cover 15 toward the interior of the vehicle, and teeth 211 at a front lower part mesh with teeth 201 of the worm wheel 20. A first coupling projection 212 in FIGS. 5 and 10 at an upper part is inserted in the arc-shaped hole 254 of the first key lever 25 to make the locking lever 21 coupled to the first key lever 25, and a second coupling projection 213 is coupled to a coupling hole 222 of the knob lever 22 through an arc-shaped hole 163 of the second cover 16.

Figure 4:
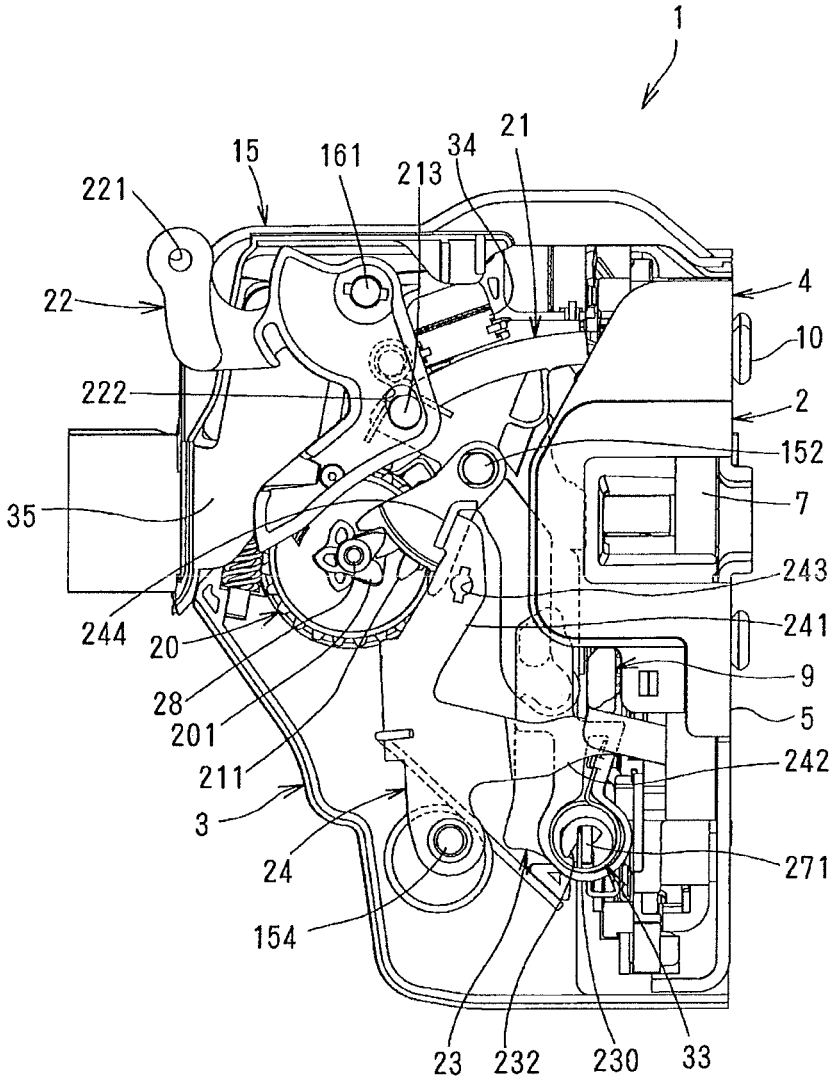
FIG. 4 is a perspective view of a main part seen from an exterior of the vehicle.
Figure 9:
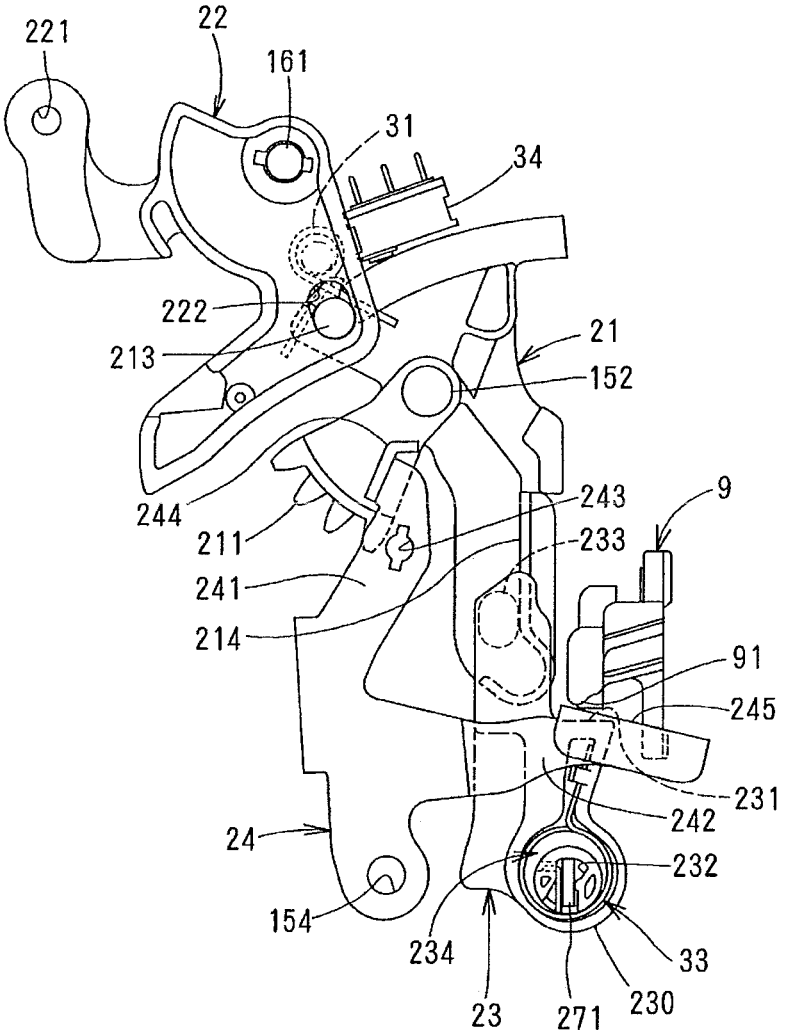
FIG. 9 is a side elevational view of the main part in an unlock state seen from an interior of the vehicle.
Figure 11:
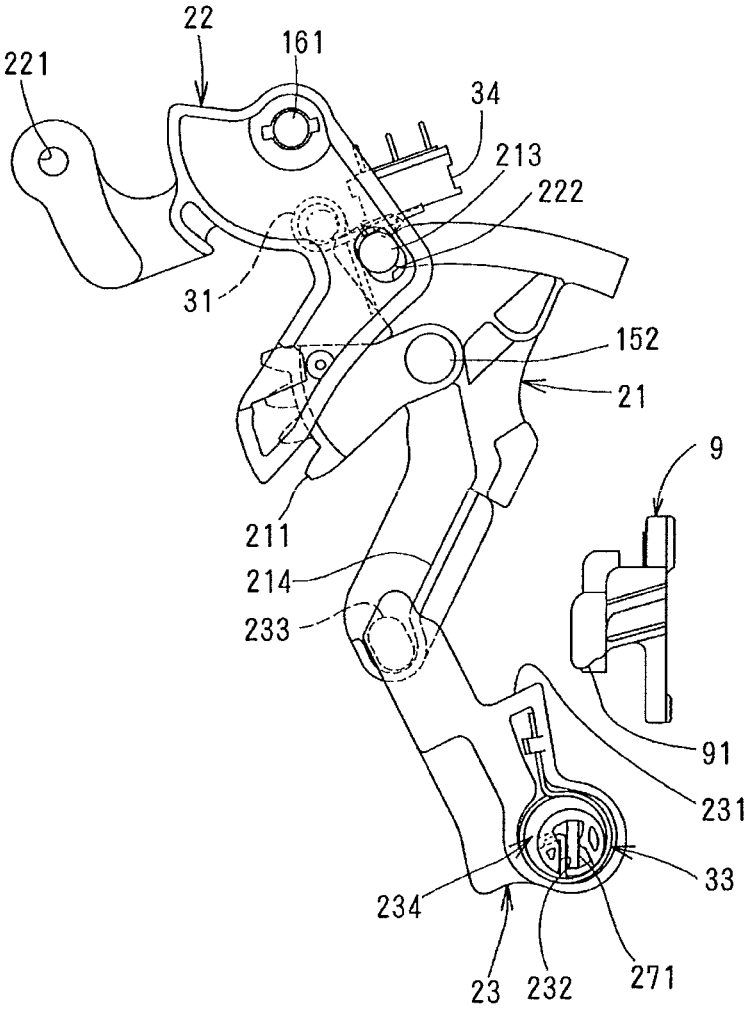
FIG. 11 is a side elevational view of the main part in the lock state seen from the interior of the vehicle.

Thus, the locking lever 21 can rotate between the unlock position in FIGS. 4 and 9 for opening the door with the outside handle based on rotation of the first and second key levers 25, 26 with the key cylinder, rotation of the knob lever 22 with the locking knob and rotation of the worm wheel 20 with the motor 19, and the lock position in FIG. 11 for preventing the door from opening with the outside handle, and is elastically held in the unlock and lock positions by an elastic holding force of a holding member 31 comprising a torsion spring.

A coil of the holding member 31 is held by a cylindrical support portion 153 of the first lever 15, and the second coupling projection 213 of the locking lever 21 is held between two arms. Thus, when the locking lever 21 rotates from the unlock position (or the lock position) to the lock position (or the unlock position), a forcing direction of the holding member 31 turns from an unlocking direction (or a locking direction) to a locking direction (or an unlocking direction) at a middle position between the unlock position and the lock position.

Figure 5:
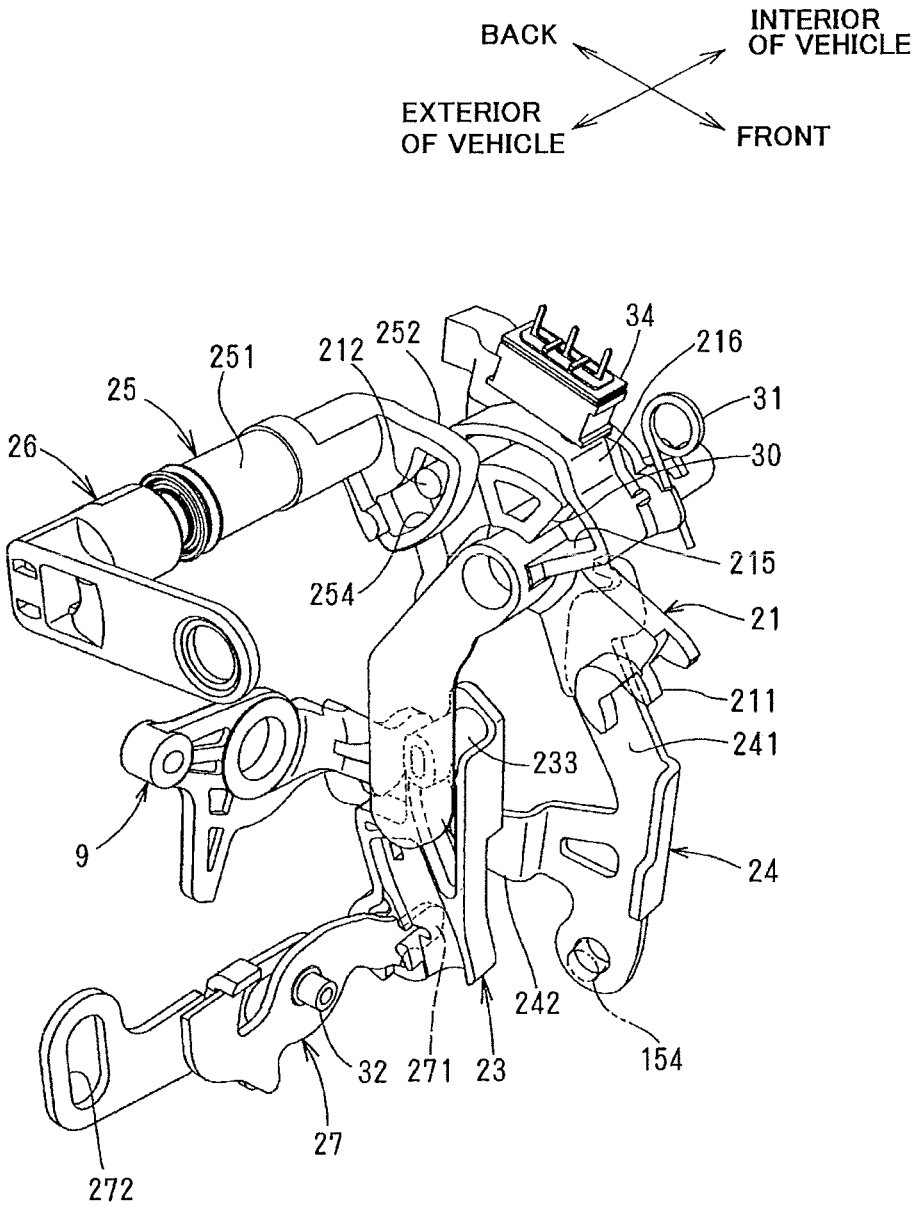
FIG. 5 is a perspective view of the main part seen from the exterior of the vehicle.
Figure 10:
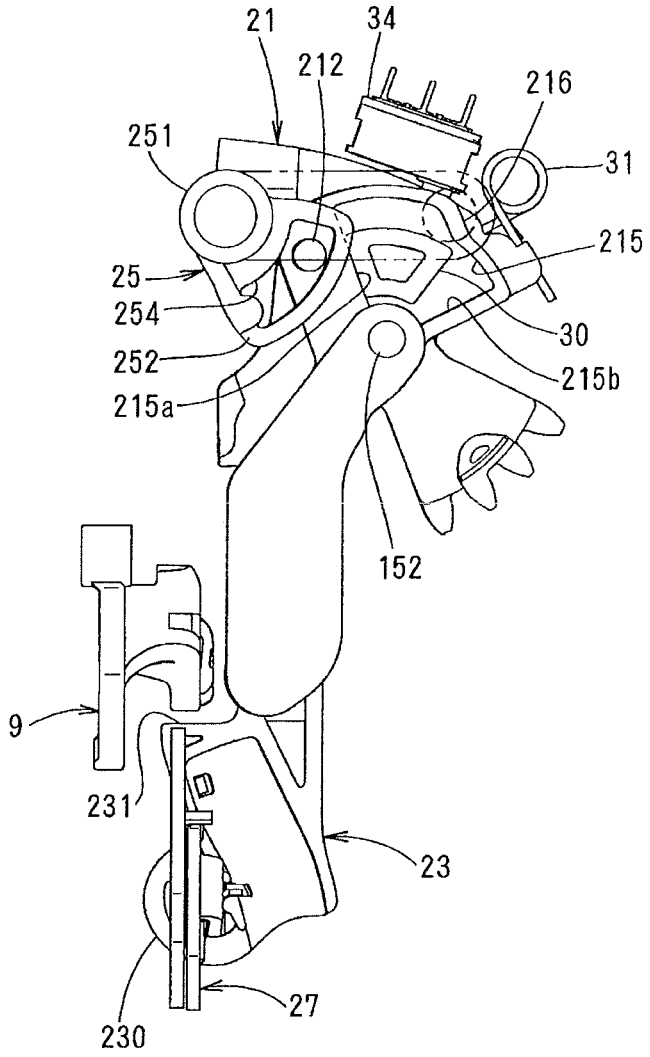
FIG. 10 is a side elevational view of the main part in the unlock state seen from the exterior of the vehicle.

The locking lever 21 stops at the unlock position and the lock position by contacting a rubber stopper 30 fixed on the inner side of the first cover 15. In FIGS. 5 and 10, an arc-shaped recess 215 is formed around an axis of the locking lever 21 close to the axis, and the stopper 30 fixed to the first cover 15 is put in the recess 215 to move in a rotational direction of the locking lever 21. Hence, the locking lever 21 rests in the unlock position by contacting one side of the stopper 30 with one surface 215*a* in the recess 215, while the locking lever 21 rests in the lock position by contacting the other side of the stopper 30 with the other surface 21 in the recess 215 in FIG. 10. With the single stopper 30, the locking lever 21 can be stopped in the lock and unlock positions. Furthermore, the stopper 30 is disposed in the recess 215 close to the axis of the locking lever 21, thereby making the stopper thinner and smaller.

On the outer periphery of an outer wall that forms the recess 215 of the locking lever 21, there is a cam surface 216 which a sensor of a detecting switch 34 contacts.

The detecting switch 34 is fixed to a switch member 35 fixed to an inner surface of the first cover 15. With rotation of the locking lever 21, the detecting switch 34 slides on the cam surface 216 to turn on/off and to transmit a signal corresponding to an unlock state/a lock state of the locking mechanism to an ECU (Electronic Control Unit) of the vehicle body.

As mentioned above, the recess 215 is formed close to the axis of the locking lever 21, the cam surface 216 is formed on the outer periphery of the recess 215 and the first coupling portion 212 is disposed close to the recess 215, so that the recess 215, the cam surface 216 and the first coupling portion 212 are close to one another, thereby making the locking lever 21 smaller.

The opening link 23 has a coupling hole 232 in a rotational central portion 230 at a lower part, and a plate-like coupling portion 271 of the outside lever 27 is inserted into the coupling hole 232, and the outside lever 27 is coupled to rotate at a certain angle longitudinally of the vehicle. A coupling portion 233 is coupled to the locking lever 21 to slide vertically, so that with move of the locking lever 21, the opening link 23 rotates around the coupling portion 271 of the outside lever 27 between an unlock position in FIGS. 4 and 9 and a lock position in FIG. 11 to which the opening link 23 rotates clockwise at a certain angle from the unlock position. In the middle of the opening link 23, there is provided a releasing portion 231 which can come in contact with a released portion 91 of the opening lever 9 from below in the unlock position.

The outside lever 27 is pivotally mounted to a lower part of the body 4 via a shaft 32, and a coupling member 272 at an outer end of the outside lever 27 is connected to an outside handle via a vertical connecting member (not shown). Based on an opening action of the outside handle, the outside lever 27 rotates in a releasing direction against an urging force of a spring (not shown), thereby moving the opening link 20 coupled to the coupling portion 271, upward for releasing.

The inside lever 24 is pivotally mounted via an axial portion 154 on an inner surface of the first cover 15, and comprises a first arm 241 upward from an arc-shaped slit 162 of the second cover 16 and a second arm 242 extending backward. At an upper part of the first arm 241, there are a coupling portion 243 connected to the inside handle via a connecting member such as a Bowden cable (not shown), and an unlocking portion 244 for turning the locked locking mechanism to an unlock state. At the end of the second arm 242, there is a releasing portion 245 for rotating the ratchet 8 in a releasing direction via the opening lever 9.

When the locking mechanism is in the unlock state, a releasing action for opening the door with the outside handle and the inside handle will be described, and a releasing action for opening the door with the inside handle will be described when the locking mechanism is in the lock state. When the locking mechanism is in the lock state, an action for opening the door with the outside handle will be described later with a panic state described later.

Figure 12:
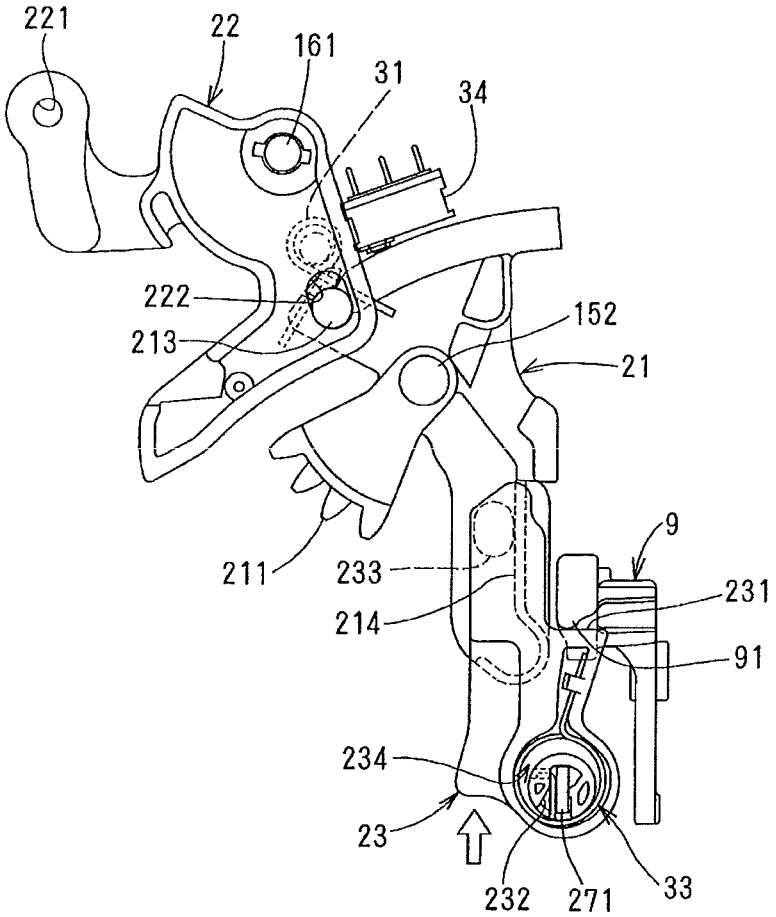
FIG. 12 is a side elevational view of the main part seen from the interior of the vehicle when an outside lever is operated for releasing.

When the door is fully closed and when the locking mechanism is in the unlock state, the outside lever 27 is operated for releasing based on door-opening action of the outside handle. In FIG. 12, the opening link 23 moves upward for releasing from the initial position in FIG. 9. With the releasing action, the releasing portion 231 comes in contact with the released portion 91 from below, thereby rotating the opening lever 9 in a releasing direction. Thus, the ratchet 8 disengages from the full-latch engagement portion 71 of the latch 7, and the door can be opened.

Based on a door-opening action of the inside handle, the inside lever 24 is operated for releasing, the releasing portion 245 of the inside lever 24 comes in contact with the released portion 91 of the opening lever 9 from below to make the opening lever 9 rotate in the releasing direction, so that the door can be opened. In this case, the opening link 27 does not work.

Figure 13:
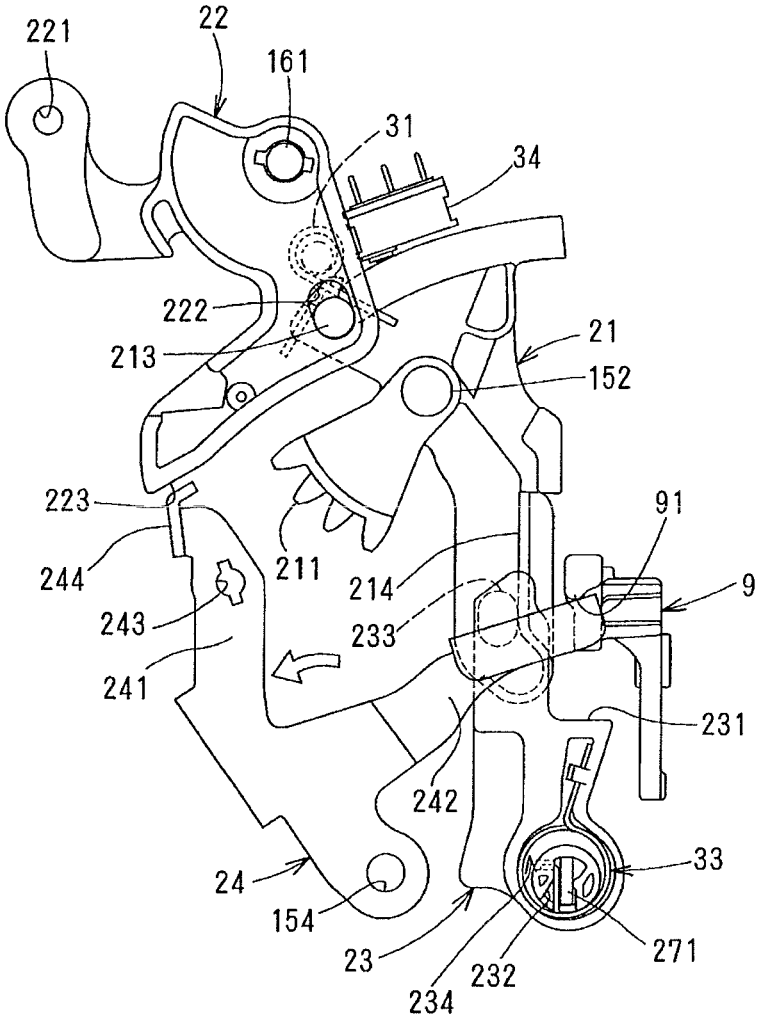
FIG. 13 is a side elevational view of the main part seen from the interior of the vehicle when an inside lever is operated for releasing.

When the door is fully closed and when the locking mechanism is in the lock state in FIG. 11, the inside lever 24 is operated for releasing with the door-opening action of the inside handle. In FIG. 13, the unlocking portion 244 of the inside lever 24 comes in contact with a contact portion 223 of the knob lever 22 in the lock position to make the knob lever 22 rotate to the unlock position. Simultaneously, the releasing portion 245 of the inside lever 24 comes in contact with the released portion 91 of the opening lever 9 from below. Hence, the ratchet 8 disengages from the full-latch engagement portion 71 of the latch 7, and the door can be opened. FIG. 13 illustrates a state after the knob lever 22 moves from the lock position to the unlock position, and the contact portion 223 of the knob lever 22 is separate from the unlock portion 244 of the inside lever 24.

(Panic State and the Structure and Function Thereon)

The locking lever 21 has a guide wall 214 extending downward from the axis, in addition to the teeth 211, the first coupling projection 212, the second coupling projection 213 and the recess 215 in FIG. 9.

In addition to the releasing portion 231 and the coupling hole 232, the opening link 23 comprises a projecting coupling portion 233 coupled to the locking lever 21 so that the coupling portion 233 slides vertically on the guide wall 214 of the locking lever 21 and can contact only when the locking lever 21 rotates in a locking direction; and a holding recess 234 for storing a torsion spring 33 (later described). By putting the coupling portion 271 of the outside lever 27 into the coupling hole 232, the opening link 23 is coupled to the locking lever 21 around the coupling portion 233 to rotate around the coupling portion 233 at a certain angle longitudinally of the vehicle with respect to the outside lever 27 so that the coupling portion 233 can slide on the guide wall 214 of the locking lever 21 and can be contacted only when the locking lever 21 rotates in the locking direction.

Figure 6:
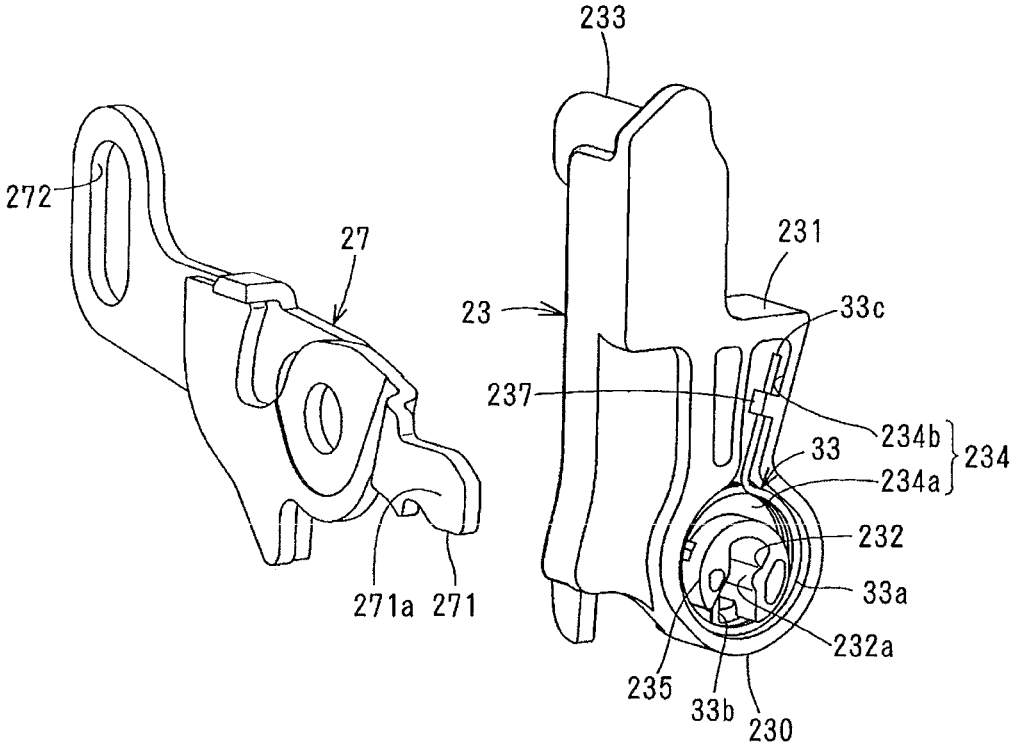
FIG. 6 is an exploded perspective view of the main part.
Figure 7:
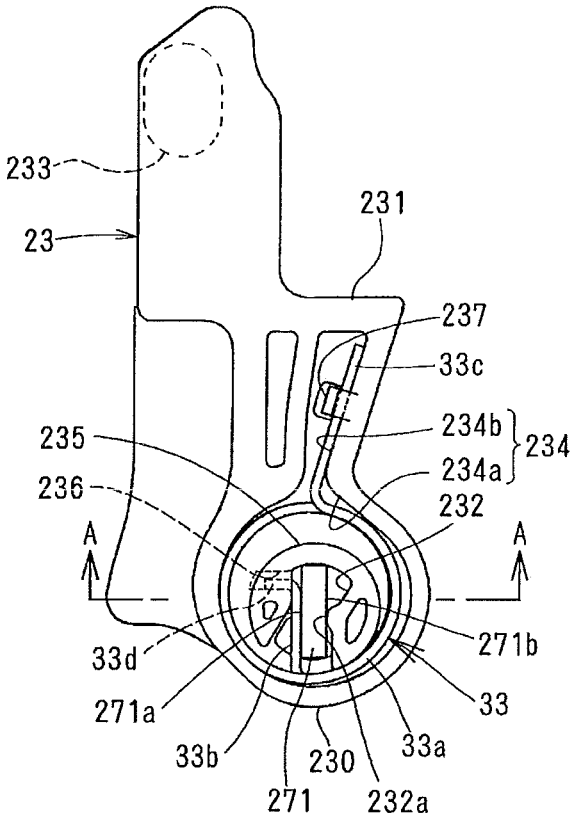
FIG. 7 is an enlarged side elevational view of the main part.
Figure 8:
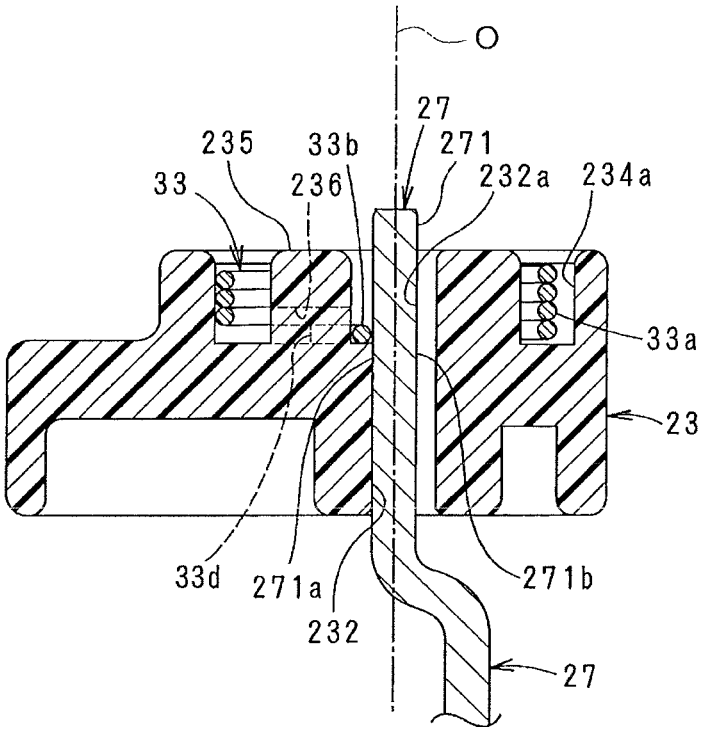
FIG. 8 is a sectional view taken along the line A-A in FIG. 7.

In FIGS. 6 to 8, a C-shaped wall 235 is disposed around the coupling hole 232 in the rotational central portion 230 of the opening link 23. The holding recess 234 comprises a circular portion 234*a* around the wall 235 to surround the coupling hole 232 and a straight portion 234*b* extending from the circular portion 234*a* upward.

In the coupling hole 232, there is formed a projection 232*a* which can contact a rear surface (other surface) of the coupling portion 271 of the outside lever 27 disposed in the coupling hole 232 in parallel with an axis (in FIG. 8) for rotating the opening link 23 around the coupling portion 271. The projection 232*a* is in contact with a flat surface 271*b* of the coupling portion 271, thereby making the opening link 23 smooth.

The torsion spring 33 comprises a coil 33*a*, a first arm 33*b* bent inward of the coil 33*a*, and a second coil 33*c* extending centrifugally of the coil 33*a*. The coil 33*a* is held in a circular recess 234*a*, and the first arm 33*b* is engaged on a front surface 271*a* (one surface) of the coupling portion 271 of the outside lever 27 from a counterclockwise direction (corresponding to an unlocking direction of the opening link 23). In FIGS. 7 and 8, an L-shaped hook 33*d* engages in an engagement hole 238 that communicates with the coupling hole 232 of the opening link 23, and the second arm 33*c* engages with a claw 237 of the opening link 23 in the straight recess 234*b* of the holding recess 234.

The coil 33*a* of the torsion spring 33 is held in the circular recess 234*a* to wind the coupling portion 271 of the outside lever 27. Thus, the torsion spring can apply an urging force to the opening link 23 in an unlocking direction anytime more effectively around the coupling portion 271 of the outside lever 27. The urging force of the torsion spring 33 is set to be smaller than an elastic holding force of the holding member 31 for elastically holding the locking lever 21 in the lock position.

The engagement hole 236 formed in the rotation central portion 230 of the opening link 23 is formed perpendicular to the axis O of the opening link 23 in FIG. 8. Thus, the claw 33*d* of the first arm 33*b* of the torsion spring 33 engages in the engagement hole 236, so that the coil 23 can be held in the circular recess 234*a* securely.

Hence, when the locking lever 21 rotates from the unlock position in FIG. 9 to the lock position, the opening link 23 rotates from the unlock position to the lock position in FIG. 11 by contacting the guide wall 214 of the locking lever 21 to the coupling portion 233 of the opening link 23. When the locking lever 21 rotates from the lock position in FIG. 11 to the unlock position, the opening link 23 rotates from the lock position to the unlock position in FIG. 9 by following a rotation of the locking lever 21 by the urging force of the torsion spring 33 without dependence on contact relationship between the guide wall 214 and the coupling portion 233.

In the lock state in FIG. 11, the urging force of the torsion spring 33 applies to the opening link 23 in an unlocking direction. Because the urging force of the torsion spring 33 is smaller than the elastic holding force for holding the locking lever 21 of the holding member 31, the locking lever 21 and the opening link 23 are not rotated by the urging force of the torsion spring 33 to the unlock position.

Then, an action will be described when a panic state occurs.

When the door is fully closed in a lock state in FIG. 11, with rotation of the outside lever 27 based on door-opening action of the outside handle, the opening link 23 moves for releasing upward from an initial lock position, but the releasing portion 231 of the opening link 9 moves in front of the released portion 91 of the opening lever 9 without contacting the released portion 91. So the opening lever 9 cannot be rotated in the releasing direction and the door cannot be opened.

Figure 14:
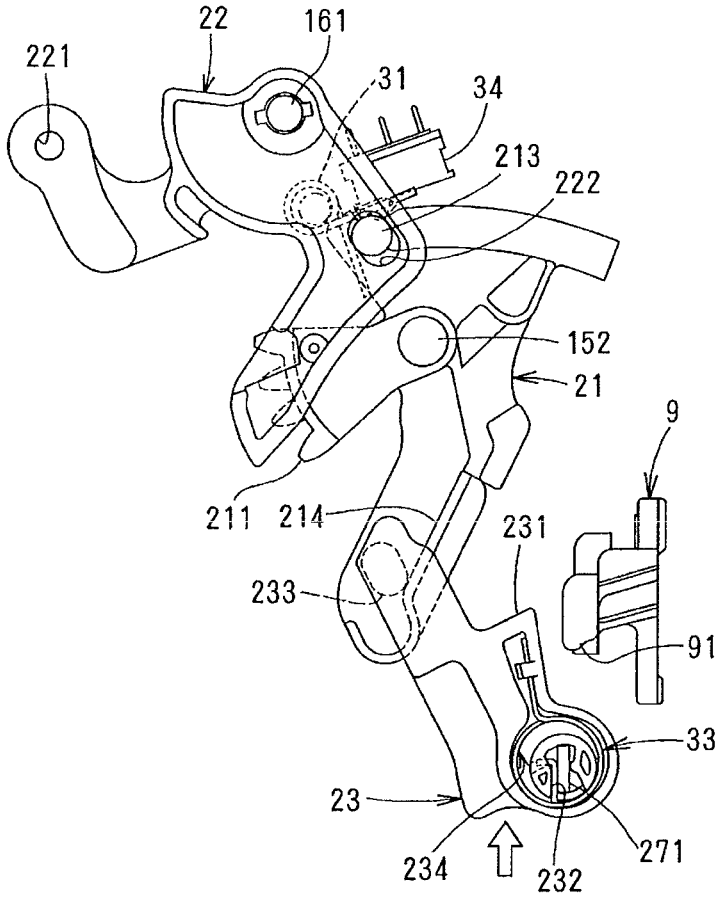
FIG. 14 is a side elevational view of the main part seen from the interior of the vehicle when it does not contact.

In FIG. 14, the switch or the locking knob is operated for unlocking, and an unlocking force is inputted into the locking lever 21. The opening link 23 rotates toward the unlock position, and part of the opening link 23 comes in contact with part of the opening lever 9 from a direction where the opening lever 9 cannot be opened, thereby causing a panic state in which the opening link 23 is prevented from rotating to the unlock position.

Figure 15:
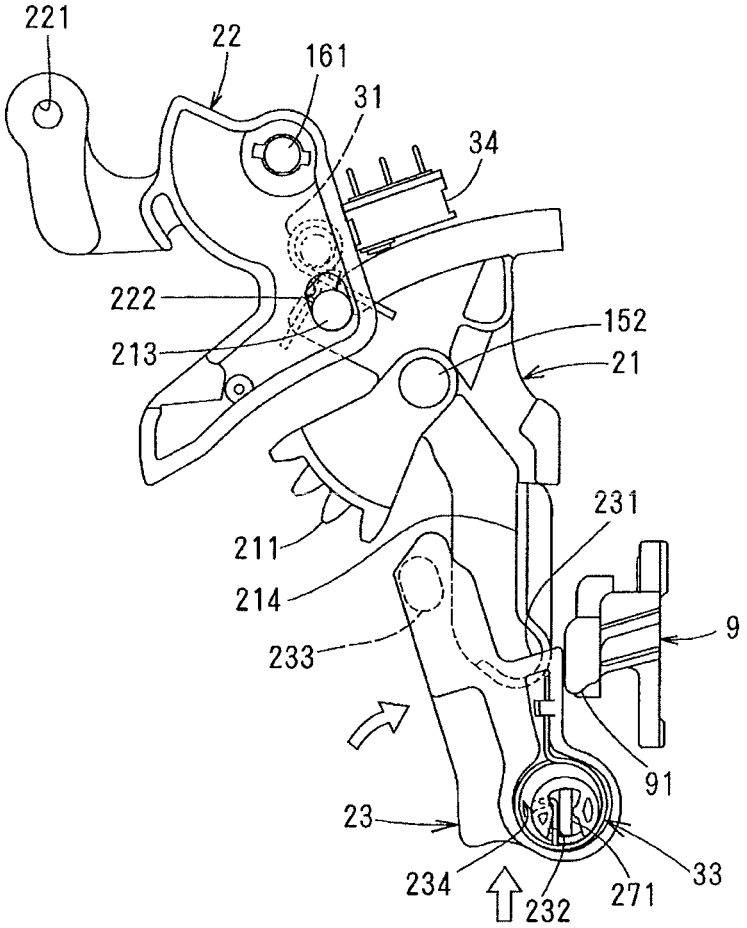
FIG. 15 is a side elevational view of the main part when a panic state occurs.

However, in this embodiment, when the locking lever 21 rotates from the lock position to the unlock position, the guide wall 214 contacts the coupling portion 233 of the opening link 214 to make the opening link 23 move to the lock position. When the lock lever 21 rotates from the lock position to the unlock position, the urging force of the torsion spring 33 rotates the opening link 23 to the unlock position without depending on a contact relationship between the guide wall 214 and the coupling portion 233. Thus, even if a panic state where the opening link 23 is prevented from moving to the unlock position occurs, the locking lever 21 can be rotated to the unlock position against the urging force of the torsion spring 33 by an urging force of the holding member 31 while the opening link 23 remains between the lock position and the unlock position in FIG. 15.

If the panic state occurs, a door-opening action of the outside handle stops temporarily. Hence, the opening link 23 moves downward, and the part of the opening link 23 leaves the part of the opening lever 9 and returns to an initial position before releasing action. The opening link 23 is moved to the unlock position by the urging force of the torsion spring 33, so that the locking mechanism turns to the unlock state.

After turning to the unlock state, the outside handle is operated to open the door, so that the door can be opened.

The door latch device 1 to which the torsion spring 33 is merely added can overcome the panic state securely.

Furthermore, the whole torsion spring 33 is held in the holding recess 234 of the opening link 23, thereby preventing the torsion spring 33 from contacting the other elements except the opening link 23 and the outside lever 27 and making the releasing action of the opening link 23 smooth.

Furthermore, the coil 33*a* of the torsion spring 33 is held in the circular recess 234*a* of the holding recess 234, and the coil 33*a* is wound on the outer periphery of the coupling portion 271 (axis of the opening link 23) of the outside lever 27, thereby identifying an urging direction of the torsion spring 33 that acts on the opening link 23 with a rotational direction of the opening link 23 around an axis of the coupling portion 171 of the outside lever 17. Thus, the urging force of the torsion spring 33 can be applied more effectively, thereby making the rotation of the opening lever 23 smooth and achieving space-saving of the torsion spring 33.

In addition to the structure in which the coil 33 of the torsion spring 33 is held in the circular recess 234*a*, the first arm 33*b* of the torsion spring 33 engages in the engagement hole 236 of the rotational central portion 230 of the opening link 23, and the second arm 33*c* engages with the claw 237 of the opening link 23, thereby enabling the torsion spring 33 to be connected to the opening link 23 provisionally. Therefore, at a connecting step in which the coupling portion 271 of the outside lever 27 is disposed in the coupling hole 232 of the opening link 23 to connect the outside lever 27 to the opening link 23, the outside lever 27 can be connected to the opening link 23 while the torsion spring 33 is connected to the opening link 23 provisionally, thereby achieving connection more effectively.

What is claimed is:

1. A vehicle door latch device comprising:

an engagement unit comprising:

a latch that is pivotally mounted via a latch shaft for rotation between an open position, a half-latch position, and a full-latch position and engages with a striker fixed to a vehicle body, a ratchet, that is pivotally mounted via a ratchet shaft, rotates to an engagement position in which the ratchet engages with a full-latch engagement portion and a half-latch engagement portion of the latch, respectively, to hold the latch in a held state, and rotates in a releasing direction to enable the latch to rotate from the held state, and an opening lever rotating in a releasing direction for releasing the ratchet from the latch;

an outside lever that performs a releasing action based on an opening action of a handle on a door;

a locking lever that can rotate between an unlock position and a lock position based on operation of a motor;

a first spring that is fixed to the locking lever so as to be able to hold the locking lever with an elastic holding force at the unlock and lock positions;

an opening link that is connected to the locking lever and is provided with a rotation central portion to which the outside lever is coupled such that the opening link is pivotally coupled to the outside lever, wherein the opening link rotates with the rotation between the unlock and the lock positions of the locking lever such that the opening link turns between an unlock position where the opening lever can rotate in a releasing direction with a releasing action of the outside lever and a lock position where the opening lever cannot rotate with the releasing action of the outside lever; and a second spring that is fixed to the opening link to apply an urging force in an unlock direction to the opening link, the urging force of the second spring being smaller than the elastic holding force of the first spring;

whereby when the locking lever is rotated in an unlocking direction in a state that the opening link is operated for releasing from the lock position by the outside lever, and therefore the opening link comes in contact with the opening lever from a direction in which the opening link cannot rotate the opening lever and the opening link is prevented from rotating to the unlock position, the locking lever can rotate to the unlock position, and the opening link returns to an initial position before the releasing action by the outside lever and is moved to the unlock position by the urging force of the second spring, wherein an engagement hole, perpendicular to an axis of the opening link, is formed at the rotation central portion of the opening link, a coil of the second spring is held in a holding recess at the rotation central portion of the opening link, a first arm of the second spring is bent inward of the coil and engages with the engagement hole of the opening link, and a second arm extends centrifugally from the coil to engage on a claw of the opening link.

2. The vehicle door latch device of claim 1, wherein a plate-like coupling portion of the outside lever is inserted into a coupling hole at the rotation central portion of the opening link thereby coupling the opening link to the outside lever to rotate around the coupling portion, and the holding recess is disposed around the coupling hole.

3. The vehicle door latch device of claim 2, wherein the first arm of the second spring engages with one surface of two sides of the coupling portion of the outside lever, and a projection is formed, on the coupling hole of the opening link, that can contact the other surface of the two sides of the coupling portion.

* * * * *